United States Patent [19]

Belttary

[11] Patent Number: 4,473,269

[45] Date of Patent: Sep. 25, 1984

[54] INTEGRAL CONNECTOR CLIP HOLDER AND CLAMP

[75] Inventor: Harold E. Belttary, Rio Piedras, P.R.

[73] Assignee: Challenger Caribbean Corporation, Canovanas, P.R.

[21] Appl. No.: 391,779

[22] Filed: Jun. 24, 1982

[51] Int. Cl.[3] ..... H01R 4/28

[52] U.S. Cl. ..... 339/258 F; 339/259 F; 339/262 F

[58] Field of Search ..... 339/258 R, 258 F, 258 S, 339/258 P, 259 R, 259 F, 262 R, 262 F

[56] References Cited

U.S. PATENT DOCUMENTS

| | | | |
|---|---|---|---|
| 2,681,396 | 6/1954 | Cole et al. | 337/67 |
| 2,922,004 | 1/1960 | Miller et al. | 339/198 N |
| 3,271,549 | 9/1966 | Gelzheiser | 200/250 |
| 3,333,078 | 7/1967 | Gelzheiser et al. | 200/275 |
| 3,383,486 | 5/1968 | Powell | 200/250 |
| 3,662,324 | 5/1972 | Schumacher | 339/255 R |
| 3,904,998 | 9/1975 | Belttary | 339/75 |
| 4,016,386 | 4/1977 | Gelzheiser et al. | 200/250 |
| 4,171,861 | 10/1979 | Hohorst | 339/198 G |
| 4,186,981 | 2/1980 | Holton | 339/258 R |
| 4,194,103 | 3/1980 | Smith | 29/622 |

*Primary Examiner*—John McQuade
*Assistant Examiner*—Gary F. Paumen
*Attorney, Agent, or Firm*—Sperry, Zoda & Kane

[57] ABSTRACT

A housing for a circuit breaker is molded with a recess and projection, for receiving a connector clip having contact blades joined by a bight. The bight has a fixed length with a first projection toward, and a longer second projection away from, the blades. The second projection is connectable to an electrical circuit. The inner surfaces of the blades are engageable with a bus bar. A clamping holder for the clip comprises an integral sheet metal member, and includes a mounting plate having a hole for retaining the clip at the bight. A flat spring means is coupled at one end by a substantially perpendicular bend to the plate and has an opposite end formed as two flat springs separated by a slot that terminates before the bend to stiffen the plate. Torque arms, coupled at one end to the flat springs at an acute angle therewith, at their other ends have opposing portions engaging the outer surfaces of the blades. Engagement of the bus bar with the inner surfaces of the blades transmits motion to the arms. This motion places the flat springs in torsion, producing a contact connecting force between the blades and the bus bar to supplement a primary force exerted by the blades. The holder is externally shaped to engage the housing recess and projection for stably mounting the clip within the housing.

8 Claims, 18 Drawing Figures

INTEGRAL CONNECTOR CLIP HOLDER AND CLAMP

BACKGROUND OF THE INVENTION

1. Field of the Invention

This invention relates to an integral connector clip holder and clamp, and, in particular, to an integral clamping holder for providing an improved mounting means and contact augmenting means for an electrical connector clip. Accordingly, it is a general object of this invention to provide new and improved holders of such character.

2. Description of the Prior Art

Connector clips have typically been mounted within recesses and/or projections in molded plastic housings, such as used for electric circuit breakers. The features of the connector clip are, thus, accommodated and the clip is secured in its intended position. Connector clips held in such manner were frequently fitted with a high carbon spring steel clamp that provided additional contact connecting force. Disadvantageously, the size of the connector clip was dictated by the molded features of the housing that held it in place. When the housing was used to enclose devices that has a broad range of electrical ratings it was noted that a connector clip of the size that satisfied the upper electrical range was larger than that needed for the lower range.

3. Statement under 37 CFR 1.56

Pursuant to the duty of candor and good faith toward the Patent and Trademark Office that rests on the application to disclose to the Office information which may be material to the examination of the application, the following United States Patents are made of record:

| U.S. PAT. NO. | PATENTEE(S) | ISSUE DATE |
|---|---|---|
| 2,681,396 | Cole et al | June 15, 1954 |
| 2,922,004 | Miller et al | Jan. 19, 1960 |
| 3,271,549 | Gelzheiser | Sept. 6, 1966 |
| 3,333,078 | Gelzheiser et al | July 25, 1967 |
| 3,383,486 | Powell | May 14, 1968 |
| 3,662,324 | Schumacher | May 9, 1972 |
| 3,904,998 | Belttary | Sept. 9, 1975 |
| 4,016,386 | Gelzheiser et al | Apr. 5, 1977 |
| 4,171,861 | Hohorst | Oct. 23, 1979 |
| 4,194,103 | Smith | Mar. 18, 1980 |

U.S. Pat. No. 2,681,396 to Cole et al. relates to a circuit breaker with spring biased pivot for movable contact members. In one embodiment having a resilient pivot, a spring member is provided with a base portion having an upturned flange at one end and having reflexed spring arms at the other end. The base portion is slotted to facilitate straddling of a movable contact member and to engage a pivot pin. Movement of the movable contact member causes the pivot pin to move downwardly to flex or compress the companion spring arms from a relaxed condition to a compressed or tensioned position.

U.S. Pat. No. 2,922,004 to Miller et al. relates to an electric circuit breaker including a plug-in type line terminal having a generally U-shaped contact jaw portion having the outer portions of its opposite sides bent inwardly to provide a resilient socket for cooperation with a contact blade. An extension of the terminal ends in two angularly disposed projections, each carrying a relatively stationary thereon. The contact jaws and the extension are positioned within a transversely extending recess in the breaker. The projections straddle a portion of the central waLL thereof and extend into other chambers. The terminal is retained in place in the chamber by the conforming recesses and abutments of the cooperating casing parts.

U.S. Pat. No. 3,271,549 to Gelzheiser relates to a circuit breaker with terminal means. Two separate line terminals are biased toward each other by means of a one-piece spring steel biasing and supporting member which is formed from a flat sheet metal blank that is folded to provide upper and lower parts. The upper part is folded to provide a flaring part. The lower part is bent along two lines to provide two staggered biasing parts on opposite sides of a slot. The member is a hardened and treated spring steel. The terminals are generally resilient conducting means. The biasing parts of the member engage outer sides of the contact parts of the terminals and bias the contact parts toward each other.

U.S. Pat. No. 3,333,078 to Gelzheiser et al. relates to a circuit breaker with plug-in type terminal structure. A line terminal comprises a sheet-metal type generally resilient flat member of conducting material having oppositely disposed large-surface-area flat face surfaces and small-surface-area end surface means between the faces. The member is U-shaped, having a short leg opposite a long leg connected by a bight. The terminal is formed with a slot which extends through the short leg and the bight, and downward a little more than half the length of the long leg. A projection, bent over from the long leg, forms a stop to position the terminal relative to a conducting stab. Two contacts, representing the stationary contacts of a double-type circuit breaker, are welded to one of the sides of the long leg.

When it is desired to mount the circuit breaker in a panelboard, the breaker is moved into position to connect the terminal with the conducting stab. During this movement, a connecting part of the stab moves between two facing end parts of the end surface means of the terminal. The dimension between the facing end parts is less than the thickness of the stab, so that as the terminal is forced onto the stab, the facing end surfaces are biased apart, spring charging the terminal member to provide contact pressure between the facing end surfaces and the opposite sides of the stab. The member is generally rigid with regard to forces applied in an endwise direction. As the member is forced onto the stab, the member flexes with a torsion or twisting action to provide a torsion-type or twisting-type spring bias of the facing end surfaces against the stab. This torsion action serves to provide effective contact pressure between the facing end surfaces and the conducting stab. When the terminal is moved into position on the stab, a projection on the member serves to position the member relative to the stab.

If it is desired to further increase the contact pressure between the facing end surfaces and the conducting stab, an additional spring member can be mounted on the terminal to provide an additional force biasing the facing end surfaces against the stab. The spring is a generally U-shaped member with the end parts thereof mounted in suitable openings in the bight part of the terminal.

It is noted that the Gelzheiser et al. device makes direct electrical contact with a bus bar stab, is required to be electrically conductive, has a circuit breaker contact welded thereto, and is not used for mounting a conductor clip, all in contradistinction to the instant invention disclosed and claimed hereinafter.

U.S. Pat. No. 3,383,486 to Powell relates to an electrical circuit breaker with combined plug-in terminal and contact support. A socket is formed of an elongated strip of metal bent upon itself into a generally U-shaped configuration. The bend is at the free end of an inner arm portion which also carries a contact button affixed to its outer surface by brazing. The socket, and particularly its base portion, are dimensioned so that the socket fits snugly onto the enlarged free end of a shoulder with the inner arm portion and the outer arm portion extending along the opposite surfaces thereof.

The strip-like elements of the socket extend in parallel contact in the inner arm portion, base portion and through a distance of the outer arm portion adjacent the base portion in the channel between the shoulder and front wall. The strip-like elements then diverge adjacent the free ends thereof in a suitable configuration to provide deflectable fingers or jaws which define a contact blade receiving channel therebetween. The outer finger has a generally V-shaped configuration and the inner finger has a more complex configuration provided by two reverse bends so that it initially extends toward the shoulder to provide the desired spacing. Its outer bend, and the bend in the outer finger, are generally aligned to ensure a high degree of clamping pressure therebetween.

The clamping pressure of the fingers is enhanced by a spring having a generally U-shaped body portion extending along the sides of the fingers parallel thereto and opening toward the channel between the fingers. At the ends of the body portion are leg portions which extend normally thereto along the outer surfaces of the fingers at their aligned bends so as to bias them together.

U.S. Pat. No. 3,662,324 to Schumacher relates to a reinforced electrical contact. The contact includes a strip of metal of high conductivity and low spring properties. The strip has three contact fingers extending from a common base to provide two contact slots in T formation therebetween. Two fingers are parallel to the base of the T and on opposite sides thereof. A third finger is parallel to the cross member of the T and is disposed above the cross member. A spring reinforcing clip for the contact is generally U-shaped. One upright of the U embraces the cross finger of the contact and has its upper end bent inwardly to bear agaist the cross finger. The other upright is forked at its upper position. The upper end of the fork is bent inwardly to engage the other surface of the parallel fingers to add spring bias to resist the spread of the fingers.

U.S. Pat. No. 3,904,998 to Belttary relates to a circuit breaker in which the fixed contact thereof is mounted on a clip which is designed to engage a line bus when the breaker is inserted into a distribution panel box.

U.S. Pat. No. 4,016,386 to Gelzheiser et al. relates to a circuit breaker line terminal. A terminal includes a plate having a doubled-back portion from which a flange extends. The portion is in surface contact with the adjacent surface of the plate to provide good electrical contact therebetween. The lower end of the flange includes an out-turned member. Stationary contacts are mounted on the side of the base plate opposite the flange. A spring clip, of spring steel, is mounted on the terminal and includes a first out-turned end portion on the side of the flange opposite a second out-turned portion. The lower leg portions of the clip engage opposite sides of the flange with the first out-turned end portion extending downwardly and outwardly to provide, in combination with the out-turned member, preshaped means for guiding the entrance of a stab between the flange and the clip, with the clip holding the flange in tight surface contact. The spring clip typically functions by way of a bending moment.

U.S. Pat. No. 4,171,861 to Hohorst relates to an electrical distribution and connection device. A clamping spring has its clamping arm provided with a recess, a clamping edge being formed therewith. The spring is bent into U-shape, with a raised portion (such as a bead) provided on a securing arm. The clamping arm and the securing arm are at an acute angle to one another and are provided on a channel-like (V-shaped) spring web via rounded portions, the securing arm being made shorter than the clamping arm. A rectangular recess is hollowed out of the clamping arm, its lower edge forming the clamping edge. In essence, the U-shaped clip with a rectangular opening in one leg acts to provide a typical bending moment.

U.S. Pat. No. 4,194,103 to Smith relates to electrical switch construction and method of making same. A contact portion of a conductive snap switch blade is adapted to be moved with a snap action between a pair of spaced contact stops. One contact stop is electrically connected to a terminal while the conductive switch blade has its other end electrically interconnected to another terminal means. The contact portion of the switch blade is adapted to electrically interconnect the terminal and the terminal means together when the contact portion has its contact snapped and held against the contact stop by an actuator means which comprises an axially movable actuator plunger and an actuator spring. The actuator spring is substantially V-shaped with an apex portion disposed between a pair of opposed ends. One end of the acuator spring is defined by a pair of spaced apart parallel legs that are interconnected by a narrow band of the actuator spring.

The narrow band of the actuator spring comprises a portion thereof that is disposed intermediate its opposed ends.

The legs of the actuator spring have concave surfaces which receive tongue edges of the switch blade that extend from its contact portion.

The other end of the actuator spring comprises a tongue having a pair of side notches formed therein to respectively receive tongue extensions of an inwardly directed tongue of the switch blade, whereby the actuator spring is placed under compression between the opposed ends thereof when the actuator spring is assembled between the tongues of the snap switch blade. The legs at the end of the actuator spring not only extend from the intermediate portion thereof to define the apex of the triangular shape of the actuator spring, but also the legs extend to the tonuge thereof that forms the other end, whereby an opening passes through the actuator spring.

SUMMARY OF THE INVENTION

An object of this invention is to provide a new and improved clamping holder, for use in an insulated housing, which housing can accommodate various size connector clips. Specifically, it is desirable for economy of materials to provide a clamping holder that supports a connector clip of a lesser size for low ampere ranges of a device, but, at the same time, accommodates molded features of the housing that are required for the maximum size connector clip used for high ampere ranges of the device.

Still another object of this invention is to provide a new and improved clamping holder constructed of low carbon steel that is not susceptible to hydrogen embrittlement nor susceptible to weakening at elevated temperatures. Specifically, through the use of an inexpensive, non-heat treated material, greater contact clamping force with lower stresses are produced in the clamping holder.

Yet another object of this invention is to provide a new and improved clamping holder which can secure an electrical connector clip in a more stable position within an insulated housing than similar devices of the prior art, thereby reducing the likelihood of misapplication of the device that employs the holder, due to the improved relationship of common mounting features between the holder and its housing.

Yet still another object of the invention is to provide a new and improved clamping holder which provides an improved mounting means and contact augmenting force for an electrical connector clip.

Another object of the invention is to provide a new and improved clamping holder which provides means for facilitating assembly of an electrical connector clip therewithin.

Still yet another object of this invention is to provide a new and improved clamping holder wherein nesting of a plurality of such holders is inhibited.

A clamping holder, in accordance with one embodiment of the invention, is useful in an insulated housing which has molded features including at least one recess and at least one projection therewithin. A clamping holder is adapted to hold an electrical connector clip which has a pair of contact blades joined together at one side each thereof by a bight having a fixed length with a short length of a first projection toward the blades and a longer length of a second projection away from the blades. The second projection is adapted to be coupled to an electrical circuit. The contact blades have inner surfaces adapted to engage a bus bar and have outward surfaces that do not engage the bus bar. The clamping holder comprises an integral member formed from a metallic sheet. The clamping holder includes a mounting plate having a hole therein formed to retain the connector clip at the bright. Flat spring means are coupled at one end thereof by a substantially perpendicular bend to the mounting plate. The flat spring means has an opposite end thereof formed as two flat springs with a slot therebetween. The slot terminates slightly before reaching the perpendicular bend in order to stiffen the mounting plate. A pair of torque arms are coupled at one extremity thereof to the flat springs at an acute angle therewith. The torque arms at an opposite extremity thereof have opposing portions thereof in engagement with the outward surfaces of the contact blades. Thus, insertion of the bus bar between the contact blades, and, thus in engagement with the inner surfaces thereof, transmits motion to the torque arms. Motion transmitted to the torque arms becomes transmitted to the flat springs placing the flat springs in torsion, thereby producing a contact connecting force between the connector slip contact blades and the bus bar to supplement a primary contact connecting force exertable by the contact blades per se. The clamping holder has an external configuration so as to engage at least one recess and at least one projection for securing the connector clip in mounting stability within the insulated housing. In accordance with certain features of the invention, the clamping holder is constructed of low carbon steel. The mounting plate can be formed with a pair of finger members, distant from the substantially perpendicular bend, that are bent inwardly towards the torque arms, whereby nesting of a plurality of holders is inhibited. The torque arms adjcent to opposing portions and toward the flat spring means have recessed portions to facilitate assembly of the electrical connector clip with the clamping holder.

In accordance with another embodiment of the invention, a clamping holder can be used in a molded plastic housing having molded features including at least one recess and at least one projection therewithin. The clamping holder holds an electrical connector clip having a pair of contact blades which are joined together at one side each thereof by a bight having a fixed length with a short length of a second projection away from the blades. The second projection is adapted to be coupled to an electrical circuit. The contact blades have inner surfaces adapted to engage a bus bar and have outward surfaces that do not engage the bus bar. The clamping holder comprises an integral member formed from a metallic sheet. The clamping holder includes a mounting plate having a hole therein. The hole has a width large enough to accommodate the clip at the bight. The hole has a length just sufficient for receipt of the fixed length of the bight plus the short length of the first projection. The holder further incudes flat spring means coupled at one end thereof at approximately right angles to the mounting plate and having an opposite end thereof formed as two flat springs with a slot therebetween. The slot terminates slightly before reaching a ninety degree bend adjacent to the mounting plate in order to stiffen the mounting plate. The flat springs are formed with coined embossments to increase tensile strength and stiffness. The clamping holder further includes a pair of torque arms coupled at one extremity thereof to the flat springs at an acute angle therewith. The torque arms, at an opposite extremity thereof, have opposing portions thereof in engagement with the outward surfaces of the contact blades, whereby insertion of the bus bar in engagement with the inner surfaces of the contact blades transmits motion to the torque arms. Motion transmitted to the torque arms becomes transmitted to the flat springs, placing the flat springs in torsion, thereby producing additional contact connecting force between the connector clip contact blades and the bus bar. The clamping holder has an external configuration so as to engage many of the molded features including at least one recess and at least one projection thereof for securing the connector clip in mounting stability within the molded plastic housing. In accordance with certain features of the invention, the clamping holder is constructed of low carbon steel. The mounting plate, distant from the flat spring means, is formed with a pair of fingers inwardly bent toward the torque arms to inhibit nesting of a plurality of clamp holders. The torque arms, adjacent opposing portions and toward the flat spring means, have recessed portions to facilitate assembly of the electrical connector clip with the clamping holder.

BRIEF DESCRIPTION OF THE DRAWINGS

Other objects, advantages and features of this invention, together with its construction and mode of operation, will become more apparent from the following description, when read in conjunction with the accompanying drawing, in which.

GENERAL DESCRIPTION

One embodiment of a clamping holder, in accordance with the invention, is depicted in FIGS. 1–4.

A second embodiment of a clamping holder, in accordance with the invention, is depicted in FIGS. 5–8.

An electrical connector clip of the prior art is depicted in FIGS. 9–12.

Views of the one embodiment of the clamping holder together with the electrical connector clip are shown in FIGS. 13–16.

Figure 17:
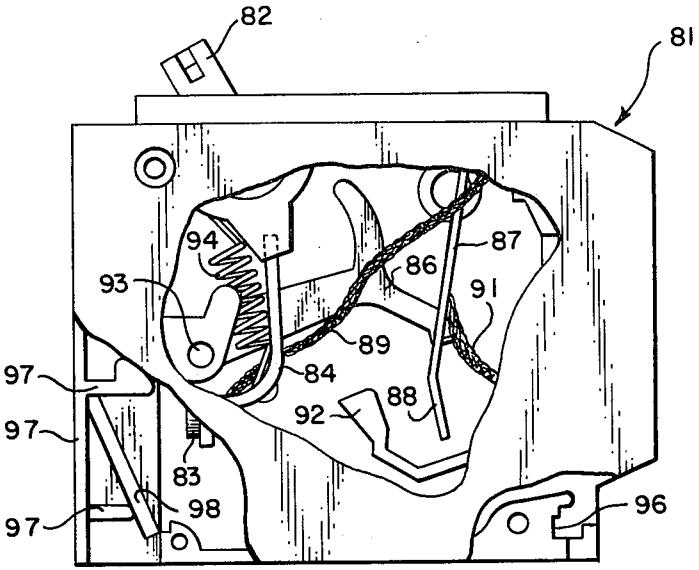
FIG. 17 is a view, partly broken away, of a molded plastic housing, such as an electric circuit breaker, showing the internal workings thereof, with the clamping holder and electrical connector clip deleted, the housing depicted in FIG. 17 illustrating a recess and projections within the molded plastic housing.

A partly broken away view of an electric circuit breaker of the prior art, with clamping holder and electrical connector clip deleted, is illustrated in FIG. 17.

Figure 18:
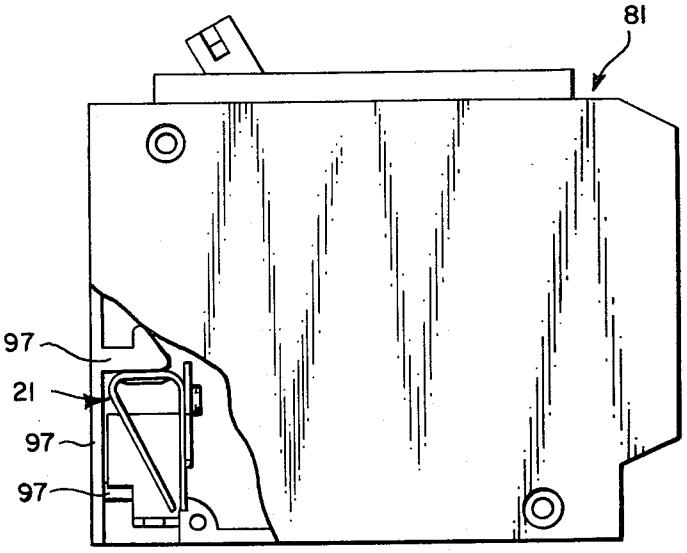
FIG. 18 is a view of the electric circuit breaker depicting the clamping holder and electrical connector clip positioned therein.

A partly broken away view of a molded plastic housing showing a clamping holder and electrical connector clip positioned therein is depicted in FIG. 18.

The electric circuit breaker of the prior art

FIG. 17 depicts an insulated, molded plastic, electrical housing 81, partially broken away, for an electric circuit breaker. The breaker includes a handle 82, a moving contact 83, a contact carrier 84, a trip arm 86, a thermostat element 87 including a ramp portion 88, flexible conductors 89, 91, an upstanding member 92, a boss 93, and a spring 94. The foregoing elements operate in known manner as set forth in U.S. Pat. No. 3,904,998. The housing 81 further includes an engagement poriton 96 for contacting a stab in an electrical control box. The housing 81 further includes projections 97, 97 and at least one recess 98 to enable a clamping holder to engage therewith.

The electrical connector clip of the prior art

Figure 11:
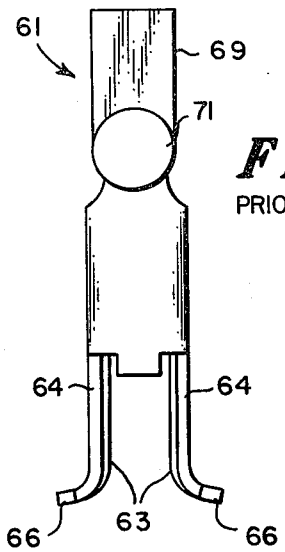
Fig. 11 PRIOR ART
FIG. 11 is a right side view of the electrical connector clip depicted in FIG. 9, the electrical connector clip depicted in FIGS. 9–11 further illustrating a fixed electrical contact on the electrical connector clip.
Figure 9:
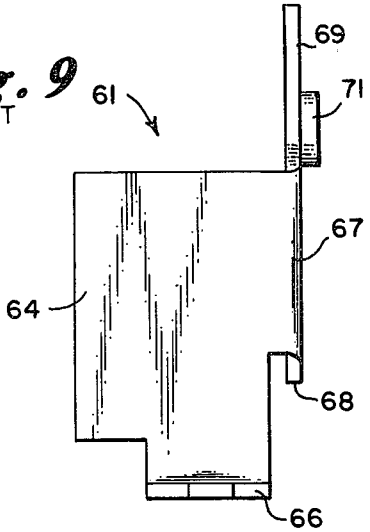
Fig. 9 PRIOR ART
FIG. 9 is a front view of an electrical connector clip which can be clamped and held by a clamping holder in accordance with this invention.
Figure 10:
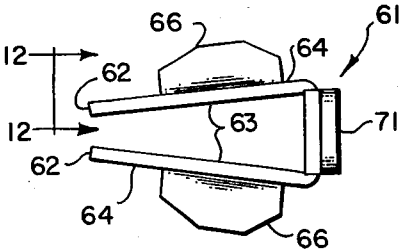
Fig. 10 PRIOR ART
FIG. 10 is a top view of the electrical connector clip depicted in FIG. 9.
Figure 12:
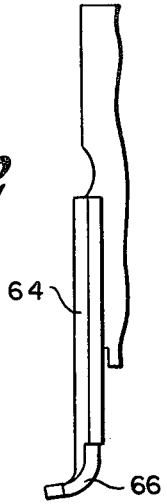
Fig. 12 PRIOR ART
FIG. 12 is a view of the electrical clip taken along the lines 12—12 of FIG. 10.
Figure 15:
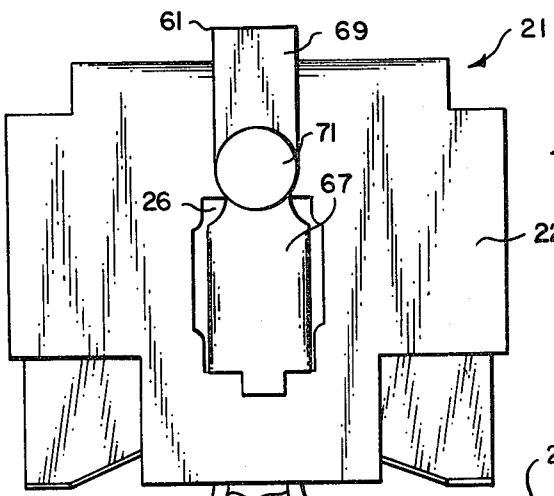
FIG. 15 is a right side view of the clamping holder depicted in FIG. 3 together with the electrical connector clip depicted in FIG. 11.
Figure 16:
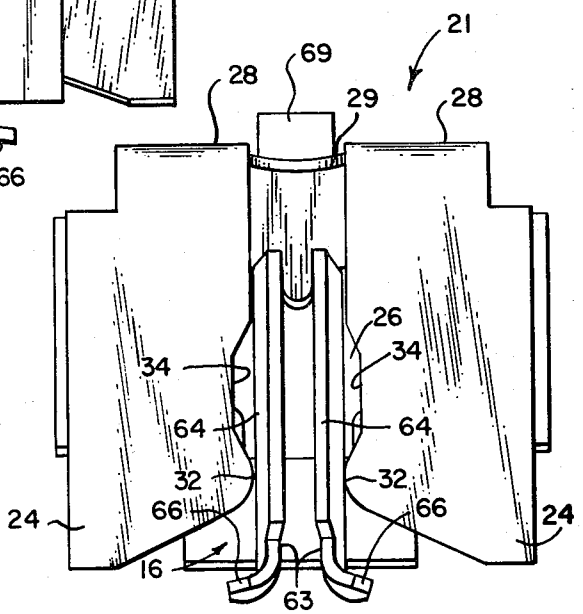
FIG. 16 is a view of the combination depicted in FIG. 13, taken along the lines 16—16 thereof.
Figure 13:
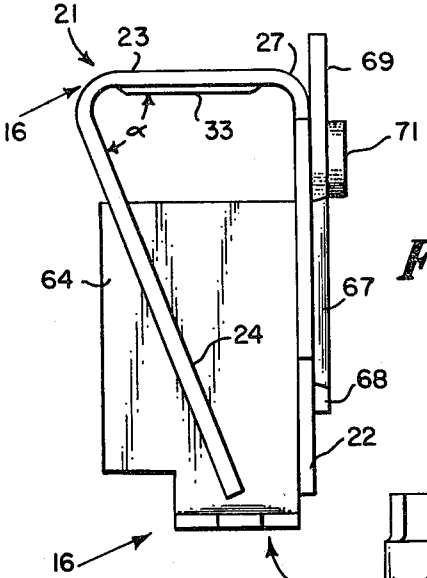
FIG. 13 is a front view of the clamping holder depicted in FIG. 1 together with an electrical connector clip as depicted in FIG. 9, assembled together.
Figure 14:
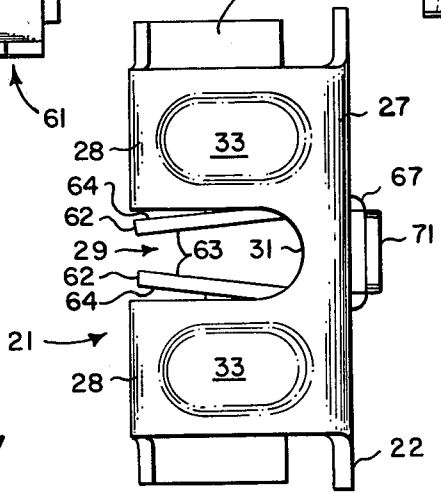
FIG. 14 is a top view of the electrical connector clip depicted in FIG. 2 and the electrical connector clip depicted in FIG. 10 in assembled relation.

An electrical connector clip 61 is depicted in FIGS. 9–12, inclusive. A front view of the electrical connector clip is depicted in FIG. 9, a top view is depicted in FIG. 10, a right side view is depicted in FIG. 11, and a canted left side view is depicted in FIG. 12.

The electrical connector clip 61 includes a pair of contact blades 62, 62 which include inner surfaces 63, 63 and outward surfaces 64, 64. Entering portions of the blades 62, 62 include outwardly flared entrances 66, 66 so that a bus bar (not shown) is insertable between the contact blades 62, 62 to engage the inner surfaces 63, 63 thereof, being guided by the entrances 66, 66.

The contact blades are joined together at the right side (FIGS. 9, 10) by a bight 67 having a fixed length. Extending from the bight 67 is a short length of a first projection 68 in a direction toward the flared entrances 66, 66. Extending from the bight 67 away from the flared entrances 66, 66 is a longer length of a second projection 69.

Optionally, a fixed contact 71 can be affixed to the projection 69 so that the fixed contact 71 becomes engageable with a movable contact of an electric breaker or other electrical device.

The prior art electrical connector clip 61, ad depicted in FIGS. 9–12, is set forth herein to enable a complete understanding of this invention.

DESCRIPTION OF PREFERRED EMBODIMENTS

A view of an electrical connector clip holder and clamp, hereinafter referred to as a clamping holder 21, is shown in a front view in FIG. 1.

The integral clamping holder 21, constructed of a sheet of metal, includes three primary portions: a mounting plate 22, flat spring means 23, and a pair of torque arms 24, 24, as depicted in FIGS. 1–4 inclusive.

The mounting plate 22 has a hole 26 therein which is formed to retain the electrical connector clip 61. The combined engaging features of the mounting plate 22 and molded housing 81 retain the connector clip 61 therewithin.

The flat spring means 23 is coupled at one end thereof by a substantially perpendicular bend 27 to the plane of the mounting plate 23. The flat spring means at its opposite end is formed with two flat springs 28, 28 having a slot 29 therebetween. The slot 29 terminates at a point 31 slightly before reaching the perpendicular bend 27 so as to assist in the stiffening of the mounting plate 22, so that bending moments applied to the mounting plate 22 through action of the flat springs 28, 28 have little affect in bending it. Rigidizing the mounting plate 22 in this manner causes the flat springs 28, 28 to be placed in torsion when loaded by movement of the torque arms 24, 24 in the intended manner. The amount that the mounting plate 22 flexes is adjustable for different applications by changing the length, width or shape of the slot 29. Likewise, the spring rate and the level of stress of the flat springs are adjustable, thereby providing adaptability of this invention to a wide variety of materials and space constrictions.

Further, the flat springs 28, 28 of the preferred embodiment have coined embossments 33, 33 causing the materials thereof to be work hardened and the cross section to be shaped in order to increase tensile strength and stiffness, respectively.

Figure 3:
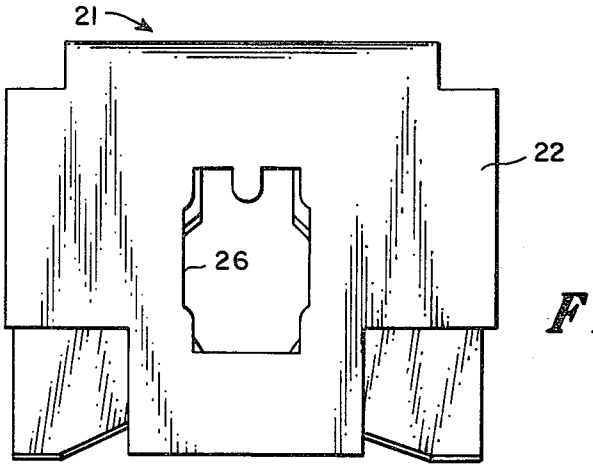
FIG. 3 is a right side view of the embodiment depicted in FIG. 1.
Figure 4:
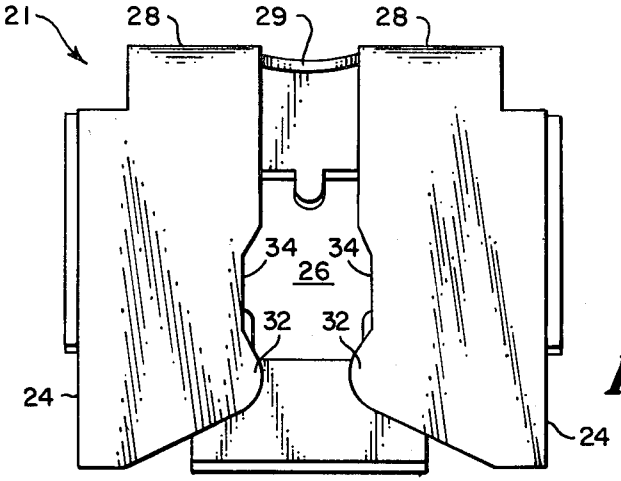
FIG. 4 is a view of the embodiment depicted in FIG. 1 taken along the lines 4—4 thereof.
Figure 1:
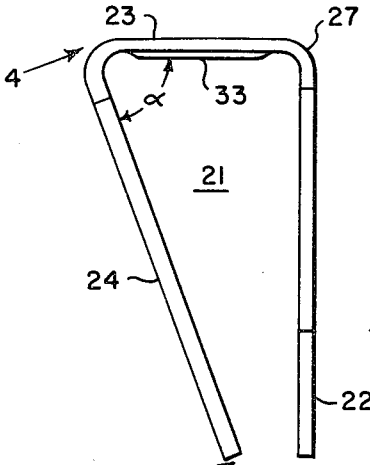
FIG. 1 is a front view of a clamping holder in accordance with one embodiment of the invention.

The torque arms 24, 24 are coupled at one extremity to the flat springs 28, 28 at an acute angle $\alpha$ to the plane thereof (FIG. 1). The torque arms 24, 24 at a point distant from the flat springs 28, 28, contain opposing portions 32, 32 which engage the outward surfaces of the contact blades of an electrical connector clip 61.

As the portions 32, 32 of the clamping holder 21 are displaced, motion becomes transmitted to the torque arms 24, 24 and is transmitted in turn to the flat springs 28, 28, placing the flat springs 28, 28 in torsion, thereby producing a contact connecting force between the connector clip contact blades and a bus bar that is inserted therein to supplement a primary contact force exertable by the contact blades per se.

The clamping holder 21 has an external configuration as clearly depicted in FIGS. 1–4 so as to engage at least one recess and at least one projection of an insulated housing for securing the electrical connector clip in mounting stability within the insulated housing.

Since the torque arms 24, 24 tightly engage the connector clip 61, engagement of peripheral portions of the torque arms 24, 24 with existing features of the molded case housing 81 of the aforementioned circuit breaker add substantially to the mounting stability of connector clip 61 within the circuit breaker and consequentially of the circuit breaker within a panel board. Further, were someone to attempt to insert an excessively oversized, bent, or otherwise distorted bus stab between the contact blades 62, 62 of the connector clip 61, then the excessive deflection of the connector clip blades 62, 62 would cause the torque arms 24, 24 to engage the walls of the circuit breaker housing 81. The user would than have to exert a force in excess of the combined reacting forces of the connector clip 61, clamping holder 21, and circuit breaker housing 81 strength.

One advantage of the invention, as noted previously herein, is that it secures the clip in position more stably than prior art devices. The structural feature that produces this increased stability is found in the external configuration of holder 21, a configuration which is specially adapted to engage at least one recess and one projection of the housing, thus effecting the desired, increased stability of the clip in its mounted position.

Another advantage of this invention is that it utilizes a less expensive, non-heat treated material to produce a greater contact clamping force with lower stress in the clamp. In accordance with a preferred embodiment of the invention, the clamping holder is constructed of low carbon steel and hence is not susceptible to hydrogen embrittlement nor is it susceptible to weakening at elevated temperatures as high carbon steel clamps.

Figure 2:
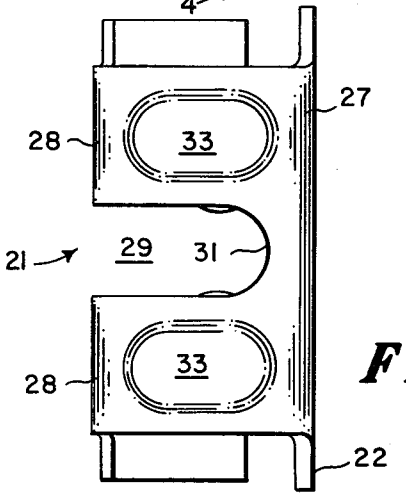
FIG. 2 is a top view of the embodiment depicted in FIG. 1.
Figure 7:
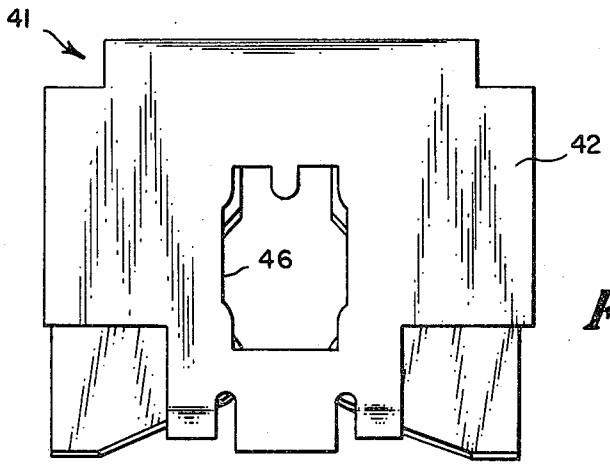
FIG. 7 is a right side view of the embodiment depicted in FIG. 5.
Figure 8:
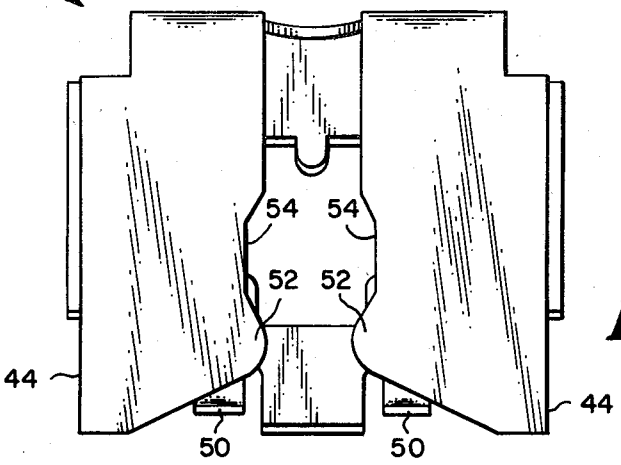
FIG. 8 is a view of the embodiment depicted in FIG. 5 taken along the lines 8—8 thereof.

Referring to FIGS. 1 and 2, there is depicted coined embossments 33, 33, one each being formed in a corresponding flat spring 28, 28. The word "coin" is a term used to describe the displacement of metal by hitting it, as may be performed by a metal stamping die. An "embossment" is a raised area from an otherwise flat surface. The use of coined embossments provides greater strength and rigidity to the flat springs and, hence, the clamping holder.

The torque arms 24, 24 are provided with recessed surface 34, 34 between the opposing portions 32, 32 and the flat springs 28, 28. The formation of recessed surfaces 34, 34 enables an electrical connector clip to be assembled with the clamping holder 21 with great facility.

Another embodiment of the clamping holder is depicted as 41 in FIGS. 5–8 inclusive. The clamping holder 41 includes a mounting plate 42 as clearly shown in FIG. 7. The mounting plate 42 is similar to the mounting plate 22 with the addition of a pair of nesting fingers 50, 50 oppositely disposed at the bottom thereof. The clamping holder 41 further includes a flat spring means 43 (identical to the flat spring means 23) and a pair of torque arms 44, 44 (identical to torque arms 24, 24).

The mounting plate 42 is formed with a hole 46 therewithin, the hole 46 having width large enough to accommodate the electrical connector clip 61 and having a length just sufficient to receive the electrical connector clip 61 for assembly therein.

The flat spring means 43 is coupled at one end 47 at approximately right angles to the mounting plate 42. The opposite end of the flat spring means 43 is formed as two flat springs 48, 48 having a slot 49 therebetween. The slot 49 terminates at a point 51 slightly before reaching the 90° bend 47 adjacent the mounting plate 42 so as to assist in stiffening the mounting plate 42.

The torque arms 44, 44 are coupled at one extremity thereof to the flat springs 48, 48 at an acute angle $\alpha$ therewith. The torque arms 44, 44 at their opposite extremity have opposing portions 52, 52 which are adapted to engage with the outward surfaces of the contact blades 62, 62 of the electrical connector flip 61. Thus, as the contact blades 62, 62 of the electrical connector clip 61 are expanded outwardly, the opposing portions 52, 52 are expanded outwardly, causing the torque arms 44, 44 to transmit motions outwardly. The motion of the torque arms 44, 44 cause the flat springs 48, 48 to be placed in torsion, thereby producing additional contact connecting force between the connector clip contact blades 62, 62 and the bus bar that may be inserted therebetween.

The flat springs 48, 48 are formed with coined embossments 53, 53 therein so as to provide the flat springs 48, 48 with greater rigidity and strength.

The torque arms 44, 44 adjacent to the opposing portions 52, 52 and toward the flat spring means 43 are formed with recessed portions 54, 54 to facilitate assembly of an electrical connector clip 61 with the clamping holder 41.

Figure 5:
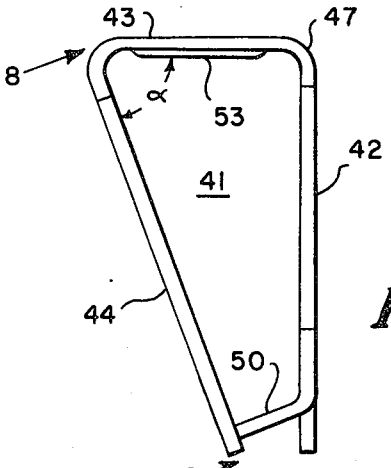
FIG. 5 is a front view of another embodiment of the invention.
Figure 6:
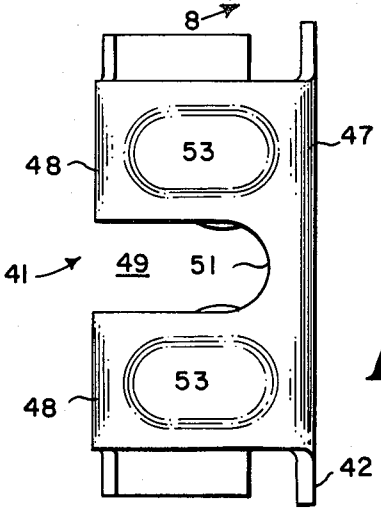
FIG. 6 is a top view of the embodiment depicted in FIG. 5.

In use, the nesting fingers 50, 50 are bent inwardly toward the torque arms 44, 44 so that they engage therewith, as shown in FIG. 5. When so engaged, a plurality of such clamping holders 41, 41 in a bin would be inhibited from nesting with one another.

Referring to FIGS. 13–16, there is depicted a clamping holder 21, as described hereinabove in connection with FIGS. 1–4 inclusive, together with an electrical connector clip 61 as described hereinabove in FIGS. 9–12 inclusive. As shown in FIGS. 13–16, the electrical connector clip 61 is held by the clamping holder 21.

Apparatus in accordance with this invention is adapted to plug on to a conductor clip 61 and the clamping holder 21 can safely accept a large range of bus bar sizes without damage thereto. Plugging the device onto a bus bar stab that greatly exceeds the intended size causes the user to exert a force in excess of the combined strengths of the connector clip 61, the holder 21, and the molded case housing 81.

It should be noted, however, that the clamping holder of the present invention acts independently of the housing 81 and produces electrical contact force whether it engages the housing or not; the added strength of the housing comes into play only to help defeat the insertion of excessively oversized bus bars not intended for the application of the circuit breaker.

FIG. 18 is a diagram similar to that of FIG. 17. The majority of the cover of the housing 81 is included. The clamping holder 21 together with an electrical connector clip 61 is shown assembled in engagement. It is noted that the overall combination resides against the projections 97, 97 and sits within the recess 98.

Various modifications can be performed without departing from the spirit and scope of this invention, it being the intent that this invention be covered solely bythe scope of the appended claims.

What is claimed is:

1. A clamping holder, for use in an insulated housing having molded features including at least one recess and at least one projection therewithin, for an electrical connector clip having a pair of contact blades joined together at one side each thereof by a bight having a fixed length with a short length of a first projection toward said blades and a longer length of a second projection away from said blades, said second projection being adapted to be coupled to an electrical circuit, said contact blades having inner surfaces adapted to engage a bus bar and having outward surfaces that do not engage said bus bar, said clamping holder comprising an integral member formed from a metallic sheet comprising:

a mounting plate having a hole therein formed to retain said connector clip at said bight;

flat spring means having one end coupled to the mounting plate by a bend extending through substantially 90° to dispose said one end of the spring means substantially perpendicularly to said mounting plate, and having an opposite end thereof formed as two flat springs with a slot therebetween, said slot terminating slightly before reaching said perpendicular bend in order to stiffen said mounting plate; and a pair of torque arms coupled at one extremity thereof to said flat springs at an acute angle therewith, said torque arms at an opposite extremity thereof having opposing portions thereof in engagement with said outward surfaces of said contact blades, whereby insertion of said bus bar between said contact blades, and thus in engagement with said inner surfaces of said contact blades, transmits motion to said torque arms, and motion transmitted to said torque arms becomes transmitted to said flat springs, placing said flat springs in torsion, thereby producing a contact connecting force between said connector clip contact blades and said bus bar to supplement a primary contact connecting force exertable by said contact blades per se;

said clamping holder having an external configuration so as to engage at least said one recess and at least said one projection for securing said connector clip in mounting stability within said insulated housing.

2. The clamping holder as recited in claim 1 wherein said holder is constructed of low carbon steel.

3. The clamping holder as recited in claim 1 wherein said mounting plate is formed with a pair of finger members, distant from said substantially perpendicular bend, bent inwardly toward said torque arms, whereby nesting of a plurality of said holders is inhibited.

4. The clamping holder as recited in claim 1 wherein said torque arms, adjacent to said opposing portions and toward said flat spring means, have recessed portions to facilitate assembly of said electrical connector clip with said clamping holder.

5. A clamping holder, for use in a molded plastic housing having molded features including at least one recess and at least one projection therewithin, for an electrical connector clip having a pair of contact blades joined together at one side each thereof by a bight having a fixed length with a short length of a first projection toward said blades and a longer length of a second projection away from said blades, said second projection being adapted to be coupled to an electrical circuit, said contact blades having inner surfaces adapted to engage a bus bar and having outward surfaces that do not engage said bus bar, said clamping holder comprising an integral member formed from a metallic sheet comprising :

a mounting plate having a hole therein, said hole having a width large enough to accommodate said clip at said bight, said hole having a length just sufficient for receipt of said fixed length of said bight plus said short length of said first projection flat spring means coupled at one end thereof at approximately right angles to said mounting plate and having an opposite end thereof formed as two flat springs with a slot therebetween, said slot terminating slightly before reaching a ninety degree bend adjacent said mounting plate in order to stiffen said mounting plate, said flat springs being formed with coined embossments to increase tensile strength and stiffness; and a pair of torque arms coupled at one extremity thereof to said flat springs at an acute angle therewith, said torque arms at an opposite extremity thereof having opposing portions thereof in engagement with said outward surfaces of said contact blades, whereby insertion of said bus bar in engagement with said inner surfaces of said contact blades transmits motion to said torque arms, and motion transmitted to said torque arms becomes transmitted to said flat springs placing said flat springs in torsion, thereby producing additional contact connecting force between said connector clip contact blades and said bus bar;

said clamping holder having an external configuration so as to engage many of said molded features including at least said one recess and at least said one projection thereof for securing said connector clip in mounting stability within said molded plastic housing.

6. The clamping holder as recited in claim 5 wherein said holder is constructed of low carbon steel.

7. The clamping holder as recited in claim 5 wherein said mounting plate, distant from said flat spring means, is formed with a pair of fingers inwardly bent toward said torque arms to inhibit nesting of a plurality of said clamp holders.

8. The clamping holder as recited in claim 5 wherein said torque arms, adjacent to said opposing portions and toward said flat spring means, have recessed portions to facilitate assembly of said electrical connector clip with said clamping holder.

* * * * *